US005211241A

United States Patent [19]

Mashaw, Jr. et al.

[11] Patent Number: 5,211,241

[45] Date of Patent: May 18, 1993

[54] VARIABLE FLOW SLIDING SLEEVE VALVE AND POSITIONING SHIFTING TOOL THEREFOR

[75] Inventors: Howard R. Mashaw, Jr., Carrollton; Christopher A. Dines, Dallas; Robert C. Hammett, Garland; Clark E. Robison, Plano, all of Tex.

[73] Assignee: Otis Engineering Corporation, Dallas, Tex.

[21] Appl. No.: 815,236

[22] Filed: Dec. 31, 1991

Related U.S. Application Data

[63] Continuation-in-part of Ser. No. 678,812, Apr. 1, 1991, Pat. No. 5,183,114.

[51] Int. Cl.[5] ..... E21B 34/14

[52] U.S. Cl. ..... 166/332; 166/320

[58] Field of Search ..... 166/319, 323, 325, 332, 166/123, 181, 182, 386, 320

[56] References Cited

U.S. PATENT DOCUMENTS

| | | | |
|---|---|---|---|
| 3,552,718 | 1/1971 | Schwegman | 166/332 X |
| 4,603,740 | 8/1986 | Edwards et al. | 166/323 X |
| 4,838,349 | 6/1989 | Berzin | 166/323 X |
| 4,842,074 | 6/1989 | Hines et al. | 166/320 X |

*Primary Examiner*—Terry Lee Melius

*Attorney, Agent, or Firm*—Roland O. Cox

[57] ABSTRACT

A sliding sleeve valve useful in a flow conduit to control and vary area of openings open for flow through the valve. The valve has a sleeve having a through flow passage and the sleeve is moveable between open, intermediate and closed positions. When the sleeve is in open position, the area open for flow through the valve is equal to area through the sleeve flow passage. As the sleeve is moved from open position to intermediate positions toward closed position, the area open for flow at each position is reduced to no area open for flow at closed position and conversely. Also disclosed is a pressure operated shifting tool which when lowered into the sleeve valve selectively locates in the valve, engages the sleeve, moves the sleeve upwardly or downwardly between positions and automatically disengages from the sleeve for retrieval. The invertible shifting module in the shifting tool is provided with a positioning sleeve which determines the distance the sleeve is moved when the shifting tool is operated. The shifting tool also includes structure for disengaging the sleeve valve if the shifting tool cannot move the sleeve or does not automatically disengage after operation and an emergency disconnect which may be operated to disconnect the flow conduit used to lower the shifting tool.

16 Claims, 10 Drawing Sheets

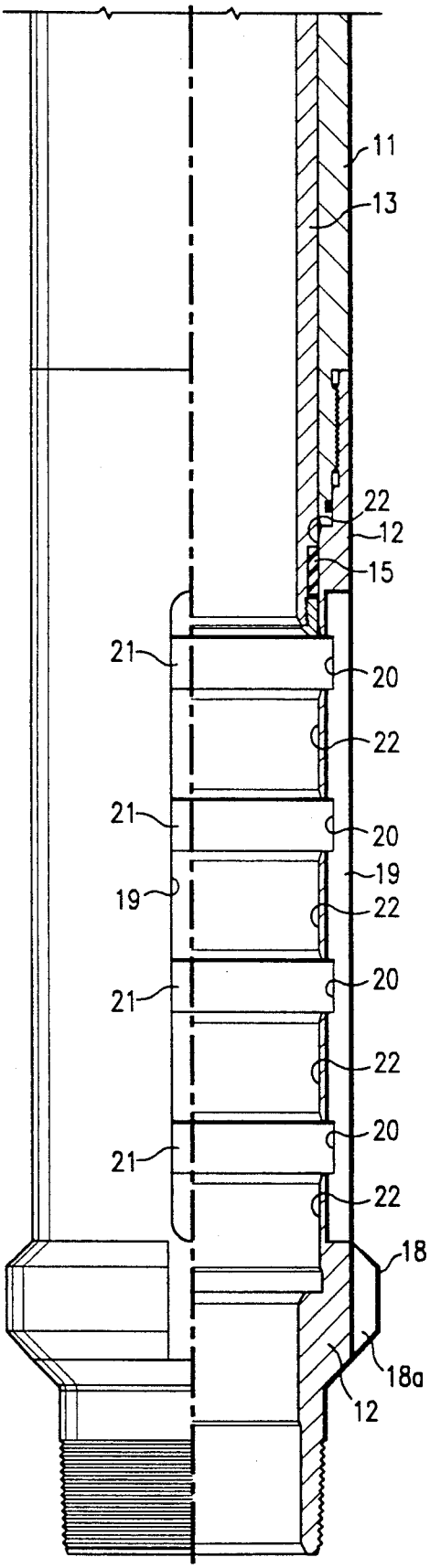
FIG. 1C
FIG. 2A
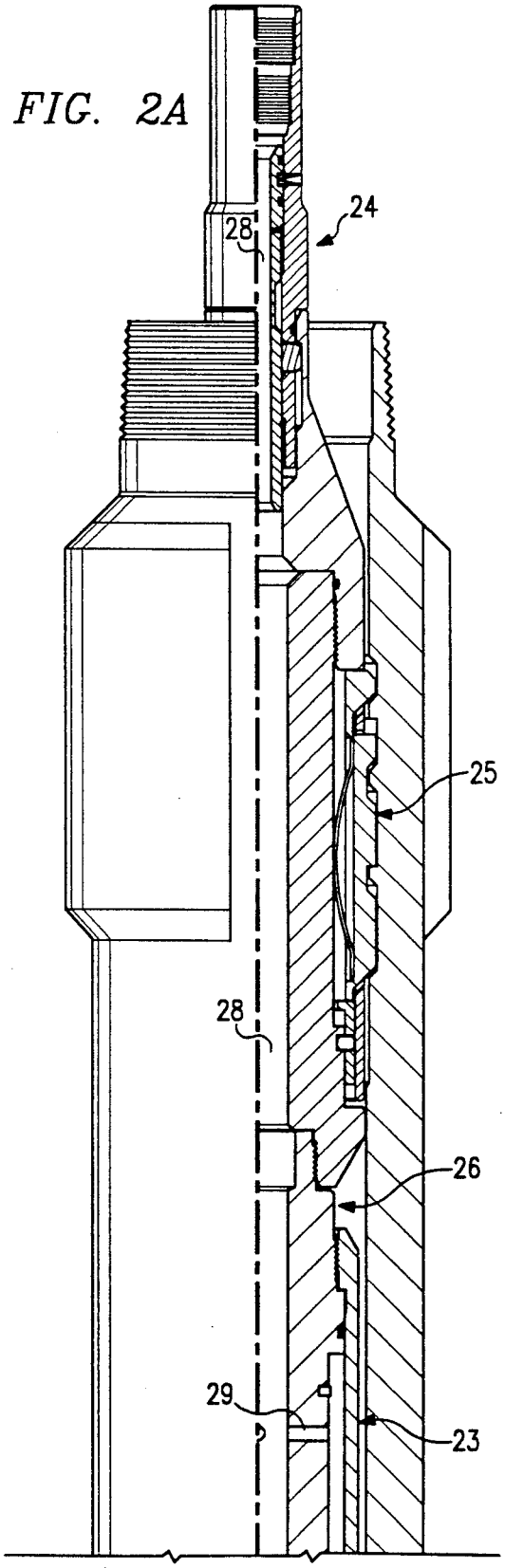

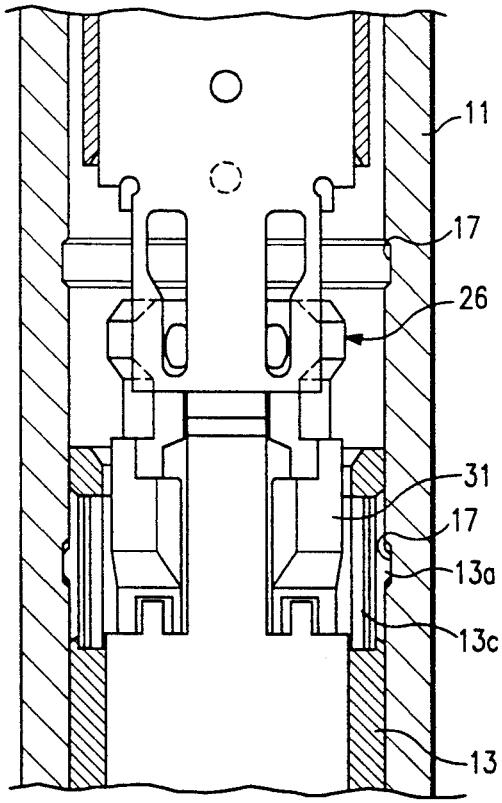
FIG. 3
FIG. 4A
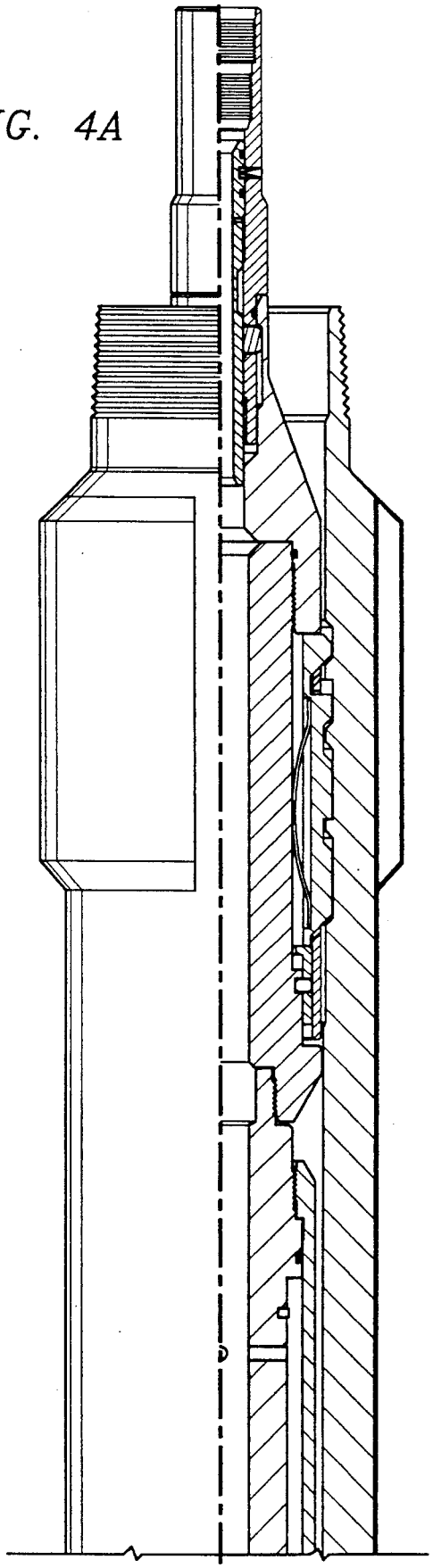

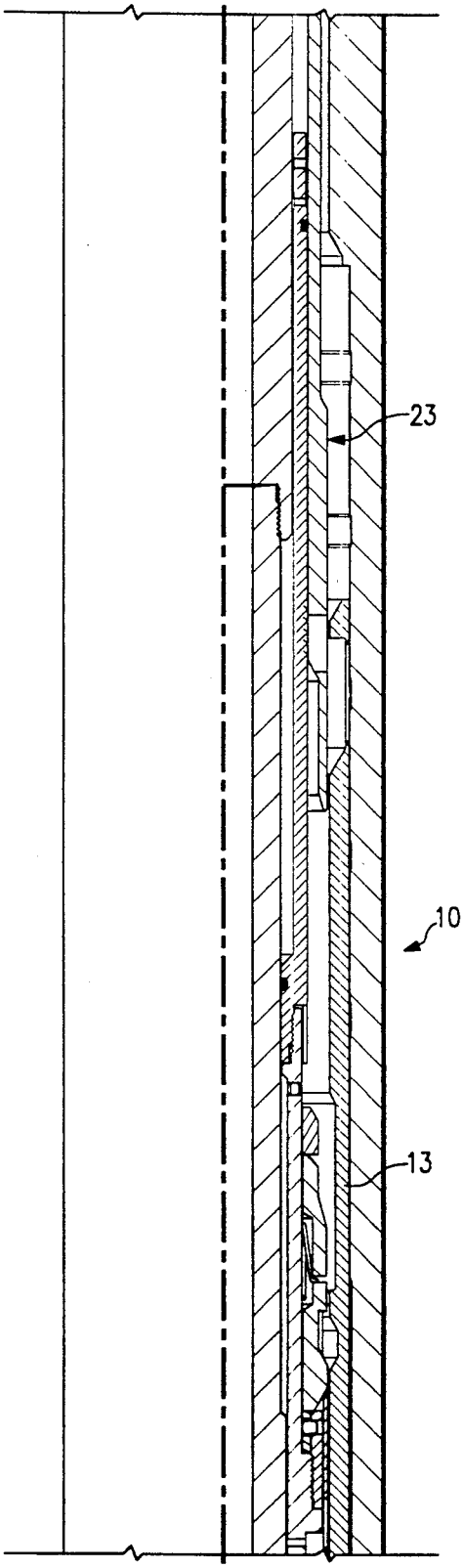
FIG. 4B
FIG. 4C
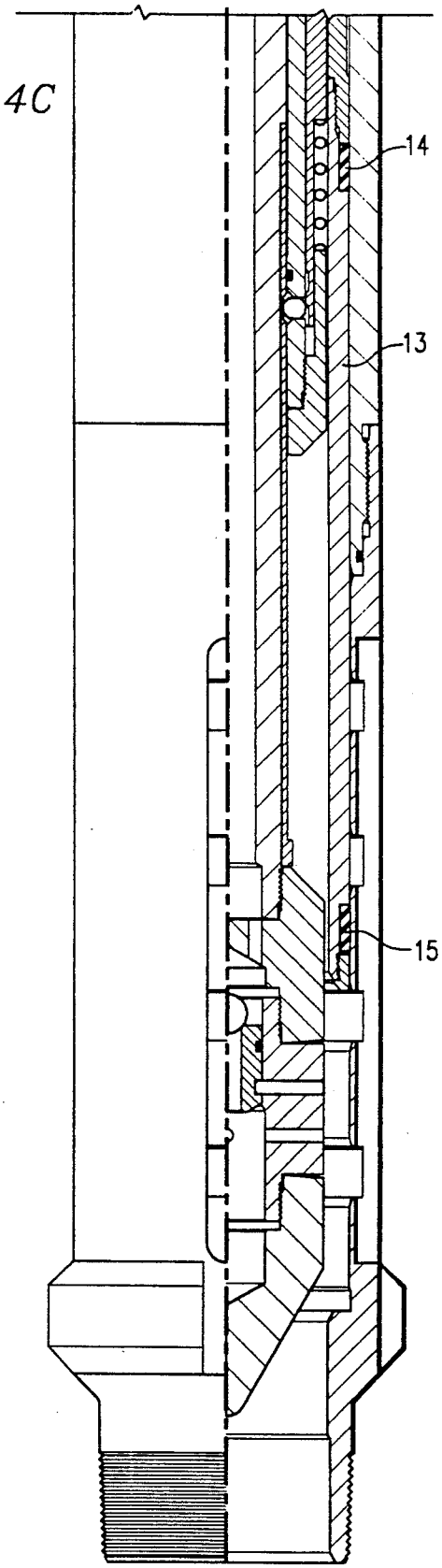

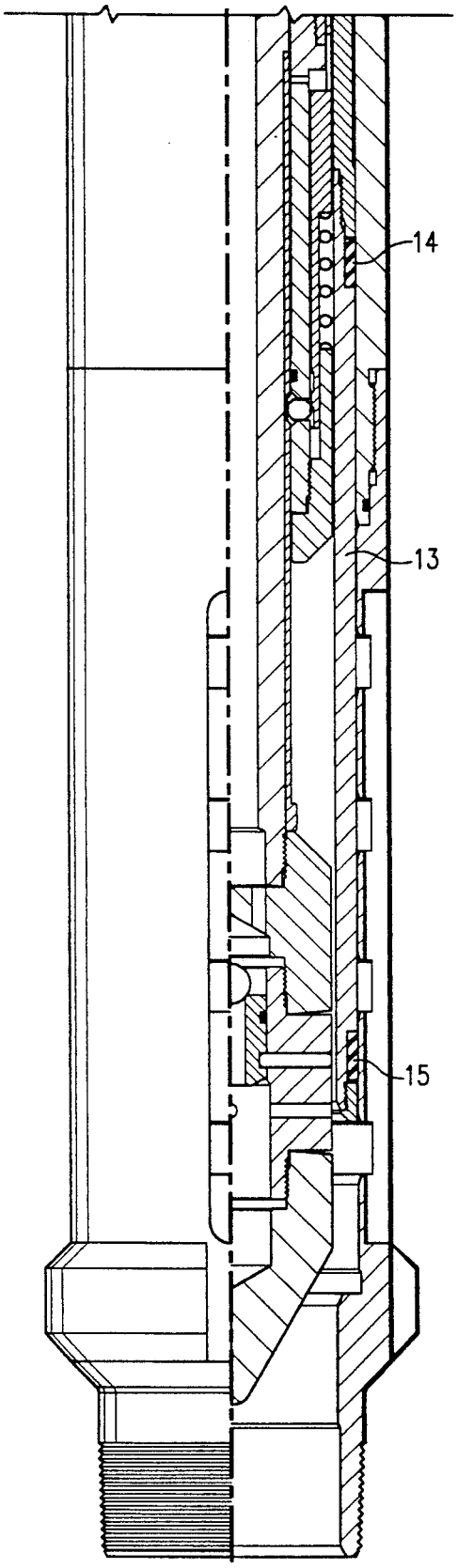
FIG. 5C
FIG. 6A
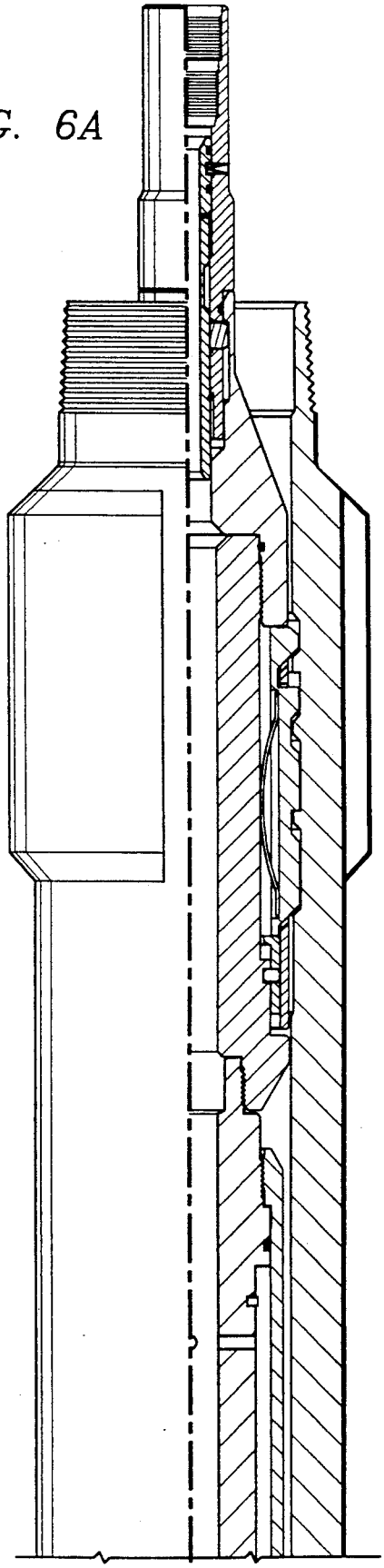

VARIABLE FLOW SLIDING SLEEVE VALVE AND POSITIONING SHIFTING TOOL THEREFOR

This application is a continuation-in-part of copending application for patent entitled "SLEEVE VALVE DEVICE AND SHIFTING TOOL THEREFOR", which was filed in the Patent and Trademark Office Apr. 1, 1991 and given Ser. No. 07/678,812, now U.S. Pat. No. 5,183,114.

BACKGROUND OF THE INVENTION (1) Technical Field:

This invention pertains to valves useful to control and vary flow between inside and outside the valve. The invention particularly pertains to a sliding sleeve type valve useful in a well conduit and a compatible selective pressure operated shifting tool which operates to open, close and vary the area open for flow through the sleeve valve wall.

(2) Background Information:

Previous sliding sleeve valves did not provide structure for varying area open for flow through wall flow openings in the valve by moving the valve sleeve to intermediate positions between open and closed positions. Previous selective pressure operated shifting tools compatible with sliding sleeve valves do not operate the sleeve valve to intermediate positions between open and closed position, decreasing the area of openings open for flow when operated from open toward closed position and increasing area of openings open for flow when operated from closed toward open position.

SUMMARY OF THE INVENTION

The invention sliding sleeve valve includes a number of rows of openings through the sleeve valve lower housing wall for flow between inside and outside the sleeve valve. There are seal bores in the lower housing above, between and below the rows of openings. The valve sleeve has a through flow passage and a lower seal which is moveable with the sleeve to positions where the lower seal engages one of the seal bores. At each position, biased lugs on the valve sleeve engage one of a number of positioning grooves in the sleeve valve upper housing to retain the valve sleeve in a position. When the valve sleeve is in open position, the cumulative area of wall flow openings open for flow is equal to the area of the flow passage through the valve sleeve. The invention valve sleeve is moveable to intermediate positions between open and closed position leaving open wall flow area equal to $\frac{3}{4}$, $\frac{1}{2}$ or $\frac{1}{4}$ of sleeve flow passage area.

Drawing Figures herein depict four rows of flow openings in the invention sleeve valve lower housing, each opening having an area. Those skilled in sleeve valve art will understand flow area change between valve sleeve positions may be varied by varying the number and area of openings in each row of openings and the changes could be random on downward or upward movement of the valve sleeve. Also, the number of valve sleeve positions and rows of openings with seal surfaces between can be varied as required.

The invention sliding sleeve valve is provided with centralizers to facilitate use in highly deviated and horizontal well bore sections and is obviously also useful in vertical well bores. Omission of the centralizers will not affect operation of the sliding sleeve valve in any way.

The invention selective pressure operated shifting tool compatible with the invention sleeve valve now includes a positioning sleeve. Positioning sleeves are provided on the invertible shifting tool module in the pressure operated shifting tool to disengage the module shifting keys from recesses in the valve sleeve after the sleeve has been moved a distance to a position determined by the positioning sleeve used. The shifting module is invertible for moving the valve sleeve downwardly or upwardly and the same positioning sleeves are used on the module to move the valve sleeve downwardly from open position to intermediate and closed positions and upwardly from closed position to intermediate and open positions. The area of openings open for flow may be randomly changed by using positioning sleeves which do not move the valve sleeve through successive intermediate positions from open to closed position or successive intermediate positions from closed to open position.

The pressure operated shifting tool also has an emergency disconnect device on its upper end which is connectible to reeled tubing and other flow conduits and is operated by dropping a ball into the disconnect device and applying a predetermined pressure on the ball to operate the device to disconnect the flow conduit from the shifting tool.

Connected on the emergency disconnect in the pressure operated shifting tool is a selective releasable locator for selectively engaging locator recesses in the sliding sleeve valve upper housing to stop down movement of the shifting tool and position the shifting tool in the sliding sleeve valve for operation of the sleeve valve.

Connected to the releasable locator in the shifting tool is the invertible shifting module which includes structure for disengaging the shifting tool module from the valve sleeve in the event the shifting tool does not automatically disengage from the valve sleeve after operation of the shifting tool or the module cannot be otherwise disengaged. Disengagement is accomplished by placing a predetermined pull force on the shifting tool to sheer pins and operate the module to disengage keys on the module from shifting recesses in the valve sleeve.

Connected on the lower end of the invertible module is a two-way valve which permits flow to occur from outside to inside the shifting tool until a predetermined pressure is applied in the shifting tool to operate the two-way valve and create a flow path for flow between inside and outside the shifting too if required.

An object of this invention is to provide a variable flow sliding sleeve valve for use in a conduit which can be operated to control flow and vary the area of openings for flow between inside and outside the valve.

Another object of this invention is to provide a variable flow sliding sleeve valve which is operable to vary the area for flow between inside and outside the sleeve valve from no flow area in closed position, through intermediate positions to an area equal to the flow area of the flow passage through the valve sleeve in open position.

Another object of this invention is to provide a selective pressure operated shifting tool having an invertible shifting module for engaging and moving the valve sleeve in a selected variable sliding sleeve valve downwardly or upwardly between open, intermediate and closed positions and after sleeve movement, the shifting module automatically disengages the valve sleeve.

Another object of this invention is to provide a selective pressure operated shifting tool having an invertible shifting module which utilizes positioning sleeves to move a valve sleeve in a variable flow sliding sleeve valve upwardly or downwardly between open, intermediate and closed positions.

Also an object of this invention is to provide positioning sleeves for the invertible shifting module which determine the distance a valve sleeve is moved when the shifting tool is operated.

BRIEF DESCRIPTION OF THE DRAWINGS

FIGS. 1A-1C are sectioned drawing in elevation of the sliding sleeve valve of this invention in open position.

FIGS. 2A-2C are also sectioned drawing in elevation showing the selective pressure operated shifting tool in disengaged position in the valve of FIG. 1 after moving the valve sleeve downwardly from open position to ¾ wall flow area open intermediate position.

FIG. 3 is a view along lines 3—3 in FIG. 2 showing a portion of the shifting tool after operation to disengage from the valve sleeve.

FIGS. 4A-4C are drawing of part of FIG. 1 showing the sliding sleeve valve in the ½ wall flow area open intermediate position.

FIGS. 5A-5C are drawing similar to FIG. 3 showing the sliding sleeve valve in ¼ wall flow area open intermediate position.

FIGS. 6A-6C are drawing similar to FIG. 3 showing the sliding sleeve valve with wall flow openings closed to flow.

DESCRIPTION OF THE PREFERRED EMBODIMENTS

Figure 1A:
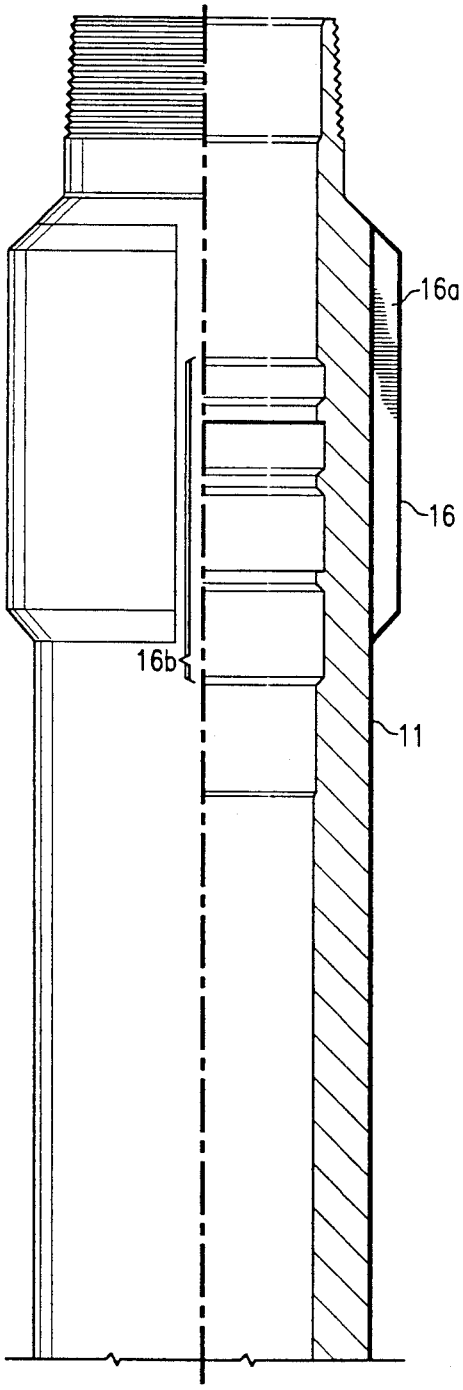
Figure 1B:
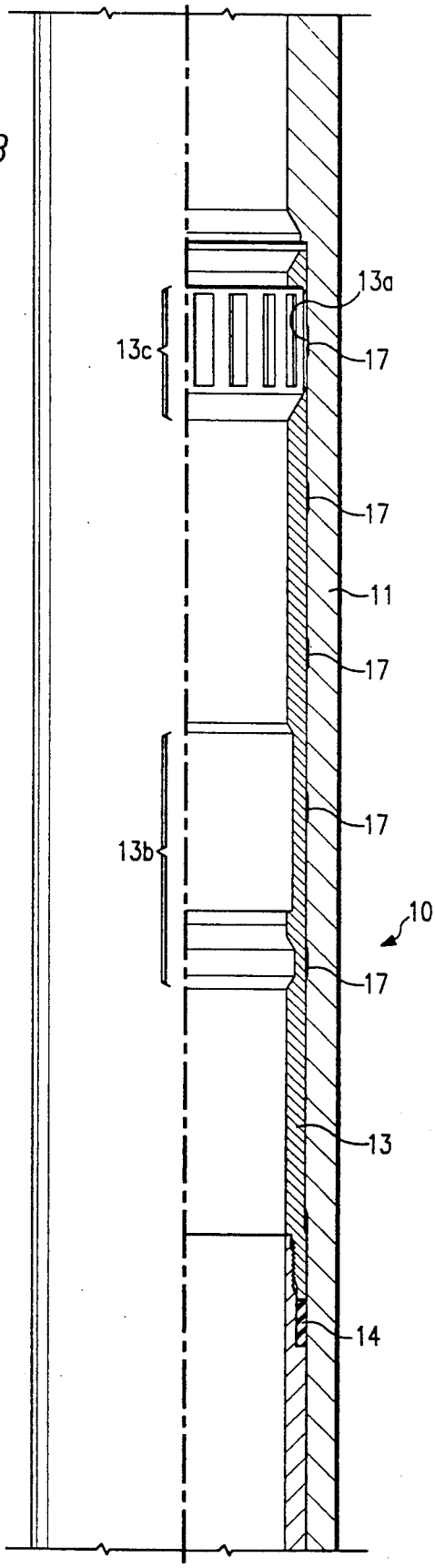

FIG. 1 shows the variable flow sliding sleeve valve 10 of the present invention which includes an upper housing 11, a lower housing 12 and a valve sleeve 13, which is slidably mounted and sealed in the housings with an upper seal 14 and a lower seal 15. The valve sleeve has a number of biased lugs 13*a*, down movement recesses 13*b*, and up movement recess 13*c*. The upper housing has been provided with a centralizer 16 having flow slots 16*a*, selective locating recesses 16*b* and a number of internal positioning grooves 17. The biased lugs are engageable with grooves 17 to retain the valve sleeve in a particular position.

The lower housing has a centralizer 18 with a number of flow slots 18*a* and a number of longitudinal flow slots 19 in the lower housing wall. A number of internal grooves 20 have been cut in the lower housing to form a number of rows of openings 21 through the lower housing wall. Seal bores 22 which are engageable by lower sleeve seal 15 have been formed in the lower housing between grooves 20. The variable sliding sleeve valve 10 is almost identical to the sliding sleeve valve of the parent application except the present invention lower housing 12 has been provided with more rows of openings 21 and seal bores 22 between the rows and the upper housing has been provided with a number of positioning grooves 17.

Figure 2B:
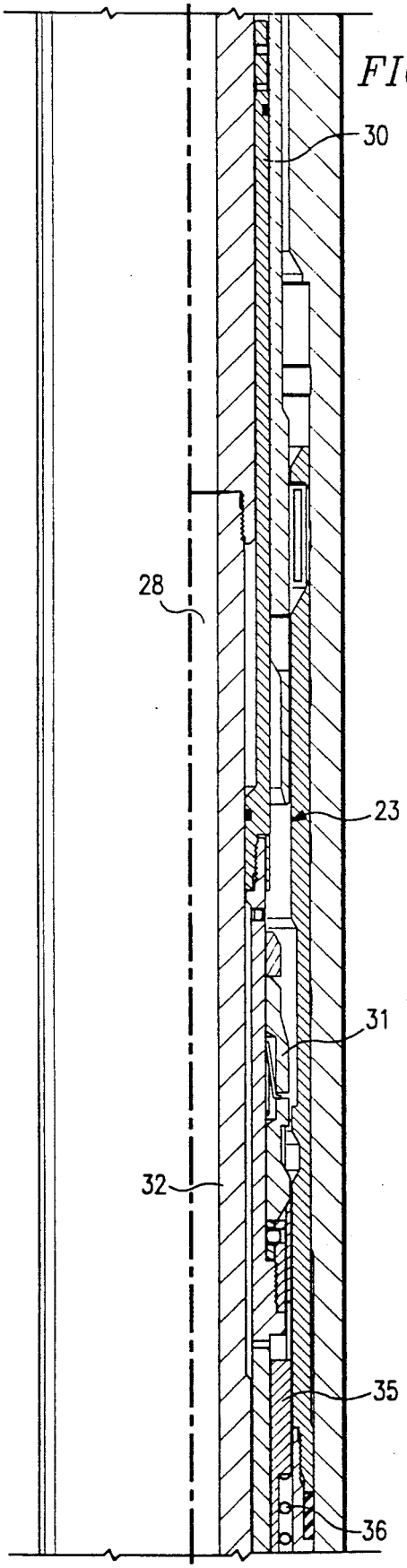
Figure 2C:
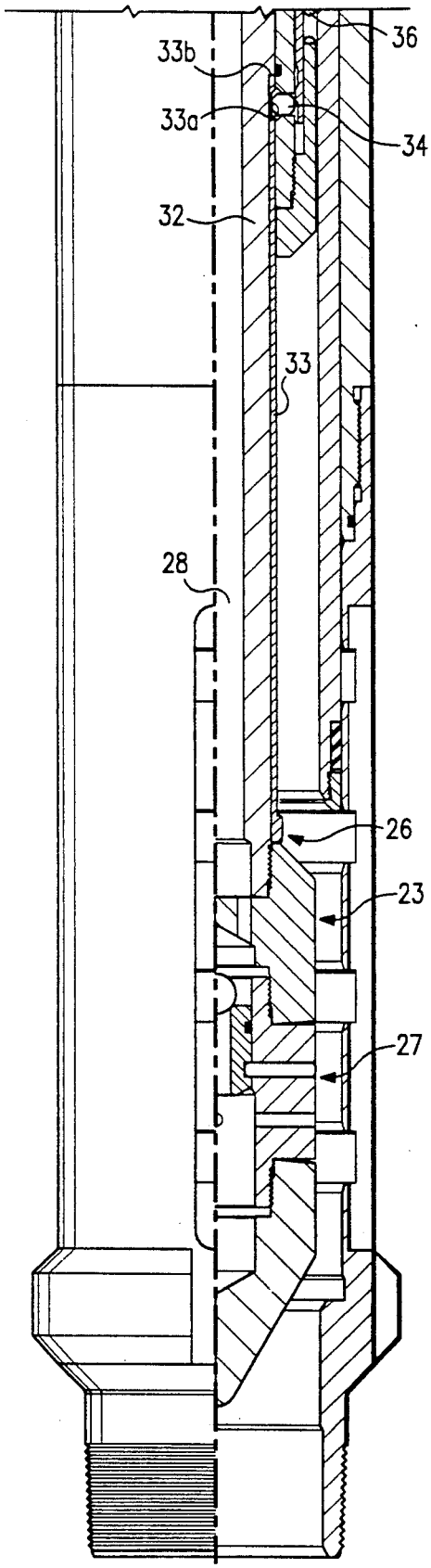

FIG. 2 shows the sliding sleeve valve 10 into which compatible selective pressure operated shifting tool 23 has been lowered on reeled tubing or a flow conductor (not shown). The shifting tool includes an emergency disconnect assembly 24, a selective releasable locator assembly 25, an invertible shifting module 26 and a two-way valve assembly 27. Locator keys on the selective releasable locator have engaged locating recesses 16*b* in the sleeve valve upper housing, stopping downward movement of the shifting tool in position to move the valve sleeve. The shifting tool has flow passages 28 and 29 and a piston 30 to which shifting keys 31 are connected. The keys are engageable in recesses 13*b* in the valve sleeve for moving the valve sleeve downwardly or recess 13*c* for moving the valve sleeve upwardly between positions. The shifting tool module includes structure for retractably mounting the keys on the shifting module so that the shifting module may be operated to retract and disengage the keys from the sleeve recesses if the keys are not automatically disengaged after the shifting tool is operated or the valve sleeve cannot be moved by the shifting tool (see FIG. 3).

Figure 7:
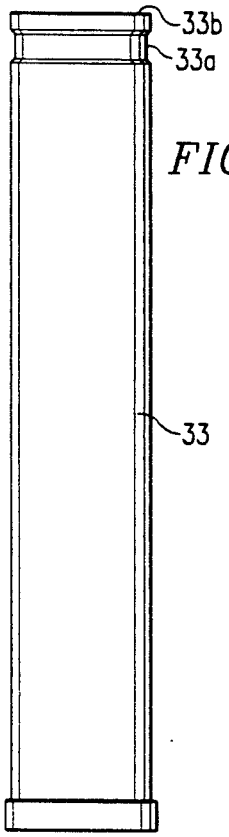
FIG. 7 is a drawing in elevation of the shifting tool positioning sleeve which moves the valve sleeve to ¾ wall flow area open intermediate position.

The mandrel 32 in the shifting tool module has been modified to receive a positioning sleeve 33, see also FIG. 7. The positioning sleeve has a positioning groove 33*a* located on the sleeve a distance from sleeve end 33*b* to move valve sleeve 13 downwardly from open to ¾ flow area open intermediate position where lower sleeve seal 15 engages upper intermediate seal bore 22, closing the upper row of openings 21 to flow. The positioning sleeve was selected and assembled on the shifting module and the module was installed on the shifting tool to move sleeve 13 downwardly that distance before the shifting tool was lowered into the sleeve valve.

In FIG. 2, pressure has been applied to fluid in the lowering flow conductor and shifting tool flow passage 28. The ball in two-way valve 27 has sealingly engaged its seat and flow has occurred from flow passage 28 through passage 29, moving piston 30, keys 31 and valve sleeve 13 downwardly from flow area full open position to flow area ¾ open intermediate position. Biased lugs 13*a* have been moved downwardly to the next lower positioning groove 17. Shifting tool keys 31 have been retracted and disengaged from the valve sleeve when release lugs 34 were adjacent and could be cammed into positioning groove 33*a* by lock sleeve 35 when moved by spring 36. The spring also moved the lock sleeve over the keys, locking the keys in retracted position. As the valve sleeve has been moved downwardly and the positioning tool has automatically disengaged from the sleeve valve, the positioning tool may be released by pulling a predetermined force to release the releasable locator and retrieved back to surface, leaving the sleeve valve ¾ flow area open for flow between inside and outside the valve or injection flow down passage 28 and out through open openings 21. If the shifting tool has not or cannot be disengaged from the valve sleeve, the shifting tool module may be operated to retract and disengage the shifting keys from the sleeve recesses by pulling a predetermined force on the shifting tool (FIG. 3). If the module is operated and does not disengage and/or the releasable locator cannot be released for retrieval of the shifting tool to surface, a ball may be dropped through the flow conductor to sealingly engage in the emergency disconnect 24. Now a predetermined pressure may be applied in the flow conductor to operate the emergency disconnect to disconnect the flow conductor from the shifting tool for retrieval of the flow conductor to surface.

Figure 5A:
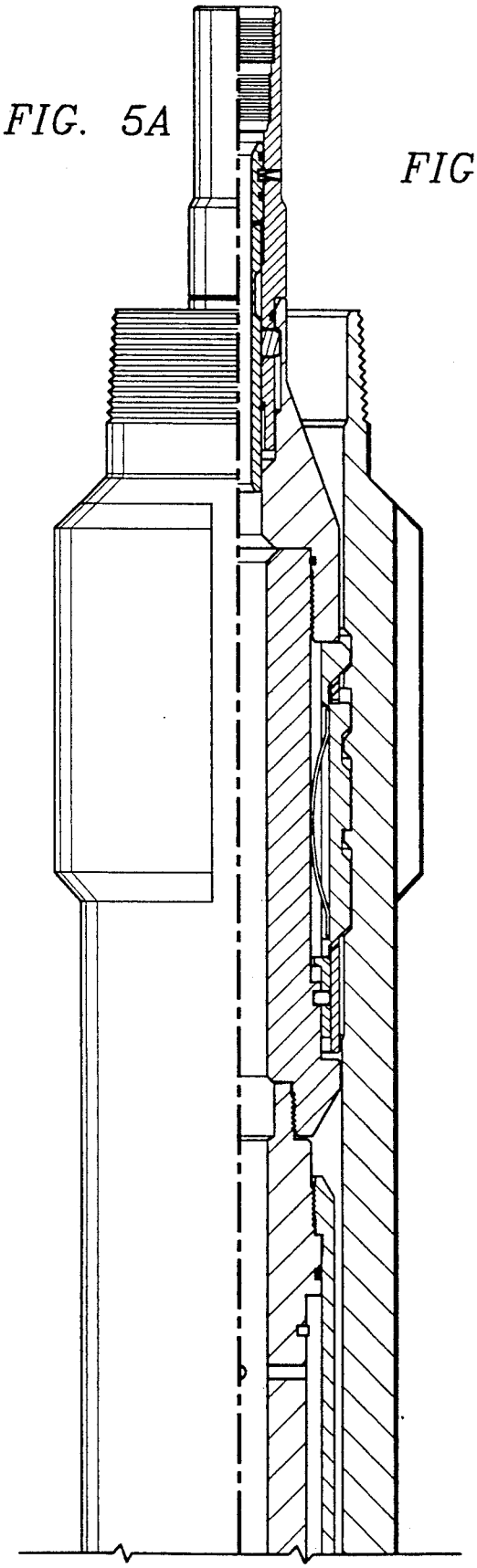
Figure 5B:
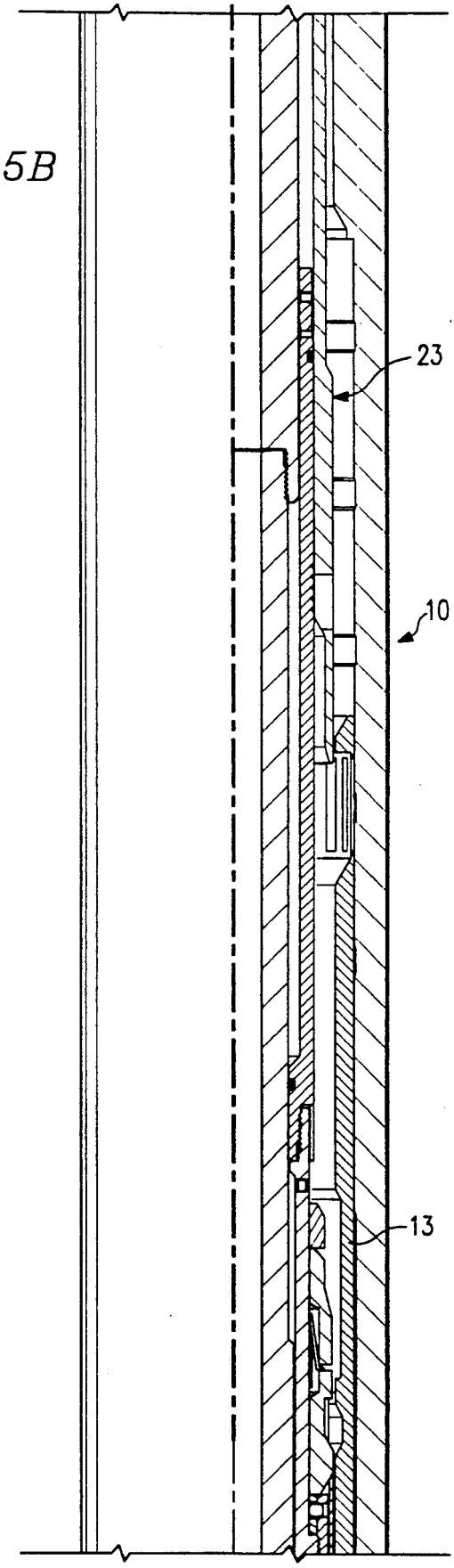
Figure 6B:
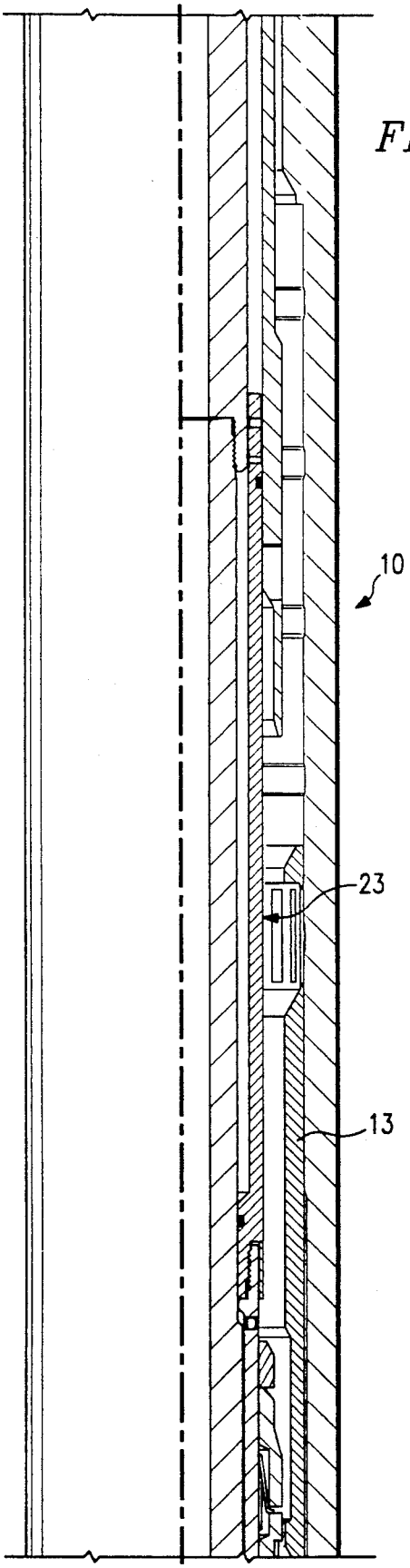
Figure 6C:
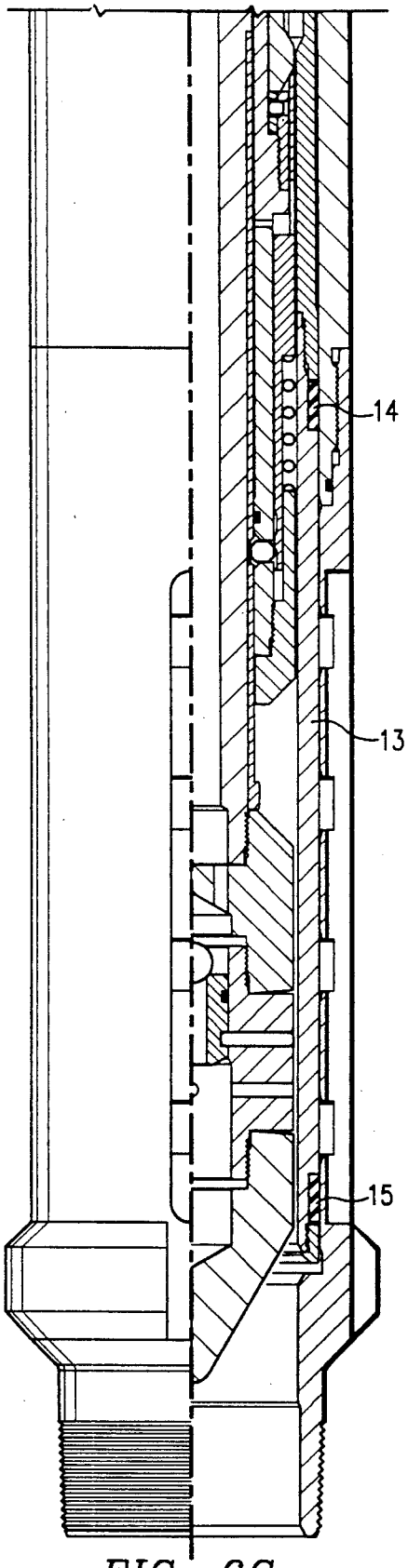
Figure 8:
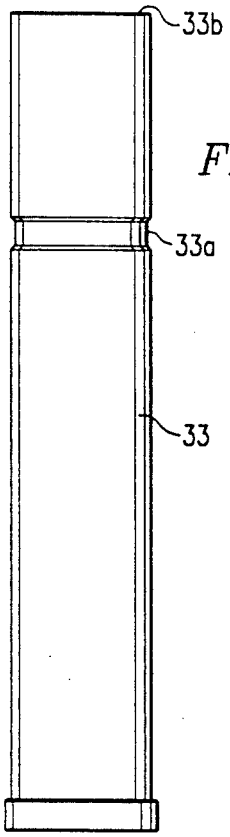
FIG. 8 is a drawing similar to FIG. 6 of a positioning sleeve which moves the valve sleeve to ½ wall flow area open intermediate position.
Figure 9:
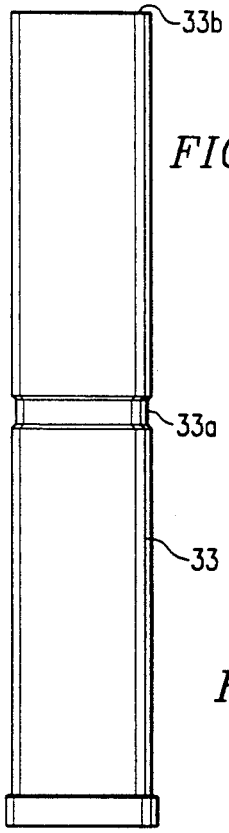
FIG. 9 is a drawing similar to FIG. 6 of a positioning sleeve which moves the valve sleeve to ¼ wall flow area open intermediate position.

The location of groove 33*a* along the positioning sleeve from end 33*b* determines the distance the shifting tool moves the valve sleeve. FIG. 7 shows a positioning sleeve oriented for downward movement, with groove 33*a* located to move valve sleeve 13 downwardly from flow area open position of FIG. 1 to ¾ flow area open intermediate position of FIG. 2 where biased lugs 13*a* engage the next lower positioning groove 17 and lower sleeve seal 15 is in upper intermediate seal bore 22. FIG. 8 shows a positioning sleeve oriented for downward movement, with a groove located to move the valve sleeve downwardly from the ¾ flow area open intermediate position of FIG. 2 to the ½ flow area open intermediate position of FIG. 4 with lugs 13*a* and seal 15 engaging the next lower groove and seal bore respectively. FIG. 9 shows a positioning sleeve oriented for downward movement, with groove located to move the valve sleeve downwardly from the ½ flow area open intermediate position of FIG. 4 to the ¼ flow area open intermediate position of FIG. 5 and FIG. 10 shows a positioning sleeve oriented for downward movement, with a groove located to move the valve sleeve downwardly from ¼ flow open intermediate position to the closed (no flow area open) position of FIG. 6.

Figure 11A:
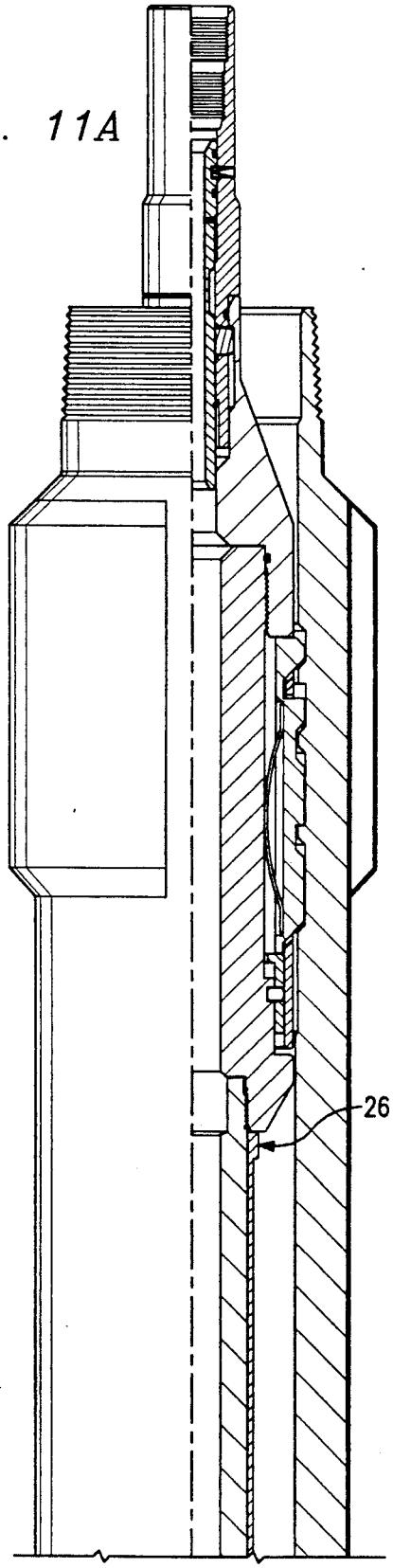
FIGS. 11A-11C are drawing similar to FIG. 2 showing the inverted shifting tool in disengaged position after moving the valve sleeve upwardly to ¼ wall flow area open intermediate position from closed position.
Figure 11B:
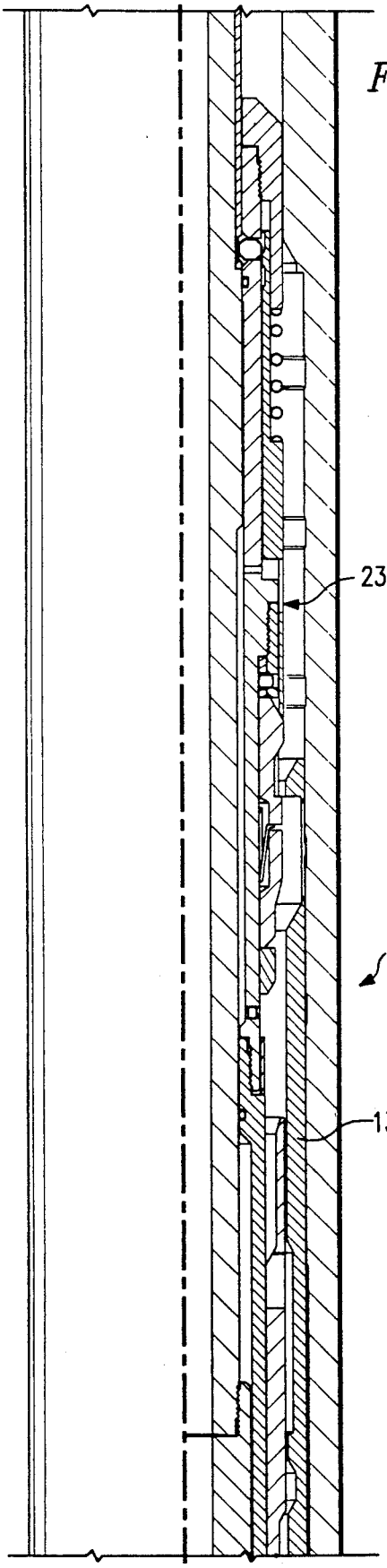
Figure 11C:
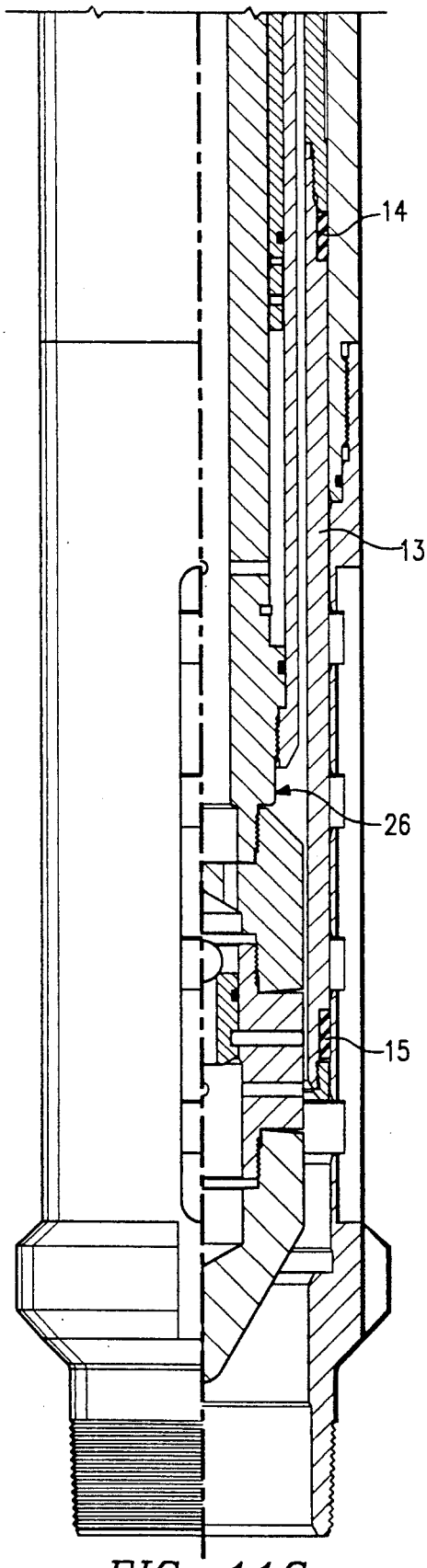

The shifting module 26 within pressure operated shifting tool 23 may be inverted to cause keys 31 to engage sleeve up movement recess 13*c* and the valve sleeve to be moved upwardly and disengage when the shifting tool is operated. The positioning sleeve of FIG. 7 has been assembled on the shifting module 26 and the module has been inverted in the pressure operated shifting tool 23 of FIG. 11. FIG. 11 shows the shifting tool has been operated to move the valve sleeve 13 upwardly from the closed position of FIG. 6 to ¼ flow area open intermediate position of FIG. 11 and has disengaged from the valve sleeve for retrieval of shifting tool 23 from sleeve valve 10.

The positioning sleeve of FIG. 8 when assembled on the shifting tool with module 26 oriented for upward movement of valve sleeve 13, will move the valve sleeve upwardly from the ¼ flow area open intermediate position of FIG. 11 to the ½ flow area open intermediate position of FIG. 4 and disengage when the shifting tool is operated.

Figure 10:
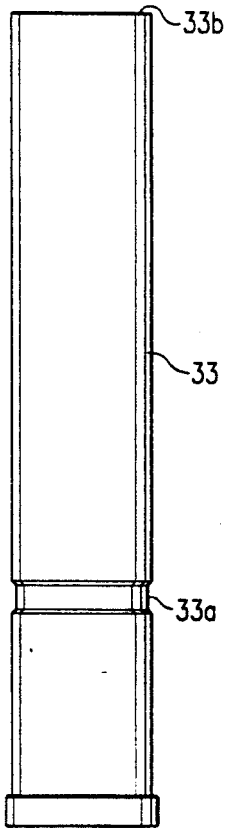
FIG. 10 is a drawing similar to FIG. 6 of a positioning sleeve which moves the valve sleeve to closed position.

The positioning sleeve of FIG. 9 when used on the upwardly moving shifting tool will move sleeve 13 upwardly from the ½ flow area open intermediate position of FIG. 4 to the ¾ flow area open intermediate position of FIG. 2 and the positioning sleeve of FIG. 10 when used on the upwardly shifting tool will move the valve sleeve from the ¾ flow area opening intermediate position of FIG. 2 to the open position of FIG. 1 where area open for flow is equal to the flow area through sleeve 13.

What we claim is:

1. A sliding sleeve valve connectable in a conduit comprising:

(a) an upper tubular housing;

(b) a lower tubular housing sealably connected to said upper tubular housing, said lower housing having openings for flow through the wall thereof;

(c) valve sleeve means mounted in said housings, said valve sleeve means longitudinally moveable to intermediate positions between fully opened and fully closed positions for controlling flow through said wall flow openings and varying wall flow area opened for flow; and (d) releasable positioning means for retaining said valve sleeve means in each of said fully opened, intermediate and fully closed positions.

2. The sliding sleeve valve of claim 1 wherein the openings for flow through the lower housing wall are arranged in rows and the lower housing has internal seal bores above, below and between said rows.

3. The sliding sleeve valve of claim 2 wherein the valve sleeve means includes a sleeve having upper and lower seals thereon and recesses therein engageable by a selective pressure operated shifting tool for moving said sleeve upwardly or downwardly, said sleeve means moveable between fully opened position where said upper seal sealingly engages the upper housing and said lower seal sealingly engages the seal bore above said rows, and intermediate positions and fully closed position, where said upper seal sealingly engages said seal bore above said rows and said lower seal sealingly engages the seal bore below said rows.

4. The sliding sleeve valve of claim 3 wherein the upper and lower sleeve seals are spaced apart on the valve sleeve so that said upper seal sealingly engages the upper housing when said lower sleeve seal engages the lower housing seal bores above and between the rows of openings and said upper sleeve seal engages the seal bore above the rows of openings when said lower seal sleeve engages the seal bore below the rows of openings.

5. The sliding sleeve valve of claim 2 wherein the area of wall flow openings opened for flow when the valve sleeve is in fully opened position is equal to or greater than the area of the flow passage through the valve sleeve and on movement of said valve sleeve from fully opened position to intermediate positions toward fully closed position, said wall flow opening area opened to flow is reduced until no wall flow openings are opened when said valve sleeve is in fully closed position, and on movement of said valve sleeve from fully closed position to intermediate positions toward fully opened position, said wall flow area is opened to flow increased.

6. The sliding sleeve valve of claim 3 wherein the releasable positioning means comprise:

(a) biased lugs on the valve sleeve; and (b) a number of positioning grooves in the upper housing, said biased lugs engageable in said positioning grooves.

7. The sliding sleeve valve of claim 6 wherein the positioning grooves are spaced apart the same distances as the seal bores in the lower housing.

8. The sliding sleeve valve of claim 1 wherein the upper housing further includes selective locator recesses therein.

9. The sliding sleeve valve of claim 1 further including means for centralizing said sleeve valve in a conduit comprising:

(a) radial projections on the upper and lower housings;

(b) longitudinal flow slots through said projections.

10. A sliding sleeve valve connectable in a conduit comprising:

(a) an upper tubular housing having selective locator recesses and a number of positioning grooves therein;

(b) a lower tubular housing sealably connected to said upper housing, said lower housing having a number of openings for flow through the wall thereof, said openings arranged in rows, said rows having seal bores, between and below said rows;

(c) valve sleeve means mounted in said housings, said valve sleeve means moveable longitudinally between fully opened and fully closed positions for controlling flow through said wall flow openings and to intermediate positions between said fully opened and fully closed positions for varying wall flow opening area opened for flow, said valve sleeve means including:

a sleeve having a flow passage therethrough, and upper and lower seals thereon, said sleeve also having recesses therein for engagement by a pressure operated shifting tool for moving said sleeve upwardly or downwardly, said upper sleeve seal sealingly engaging said upper housing and said seal bore above said lower housing rows when in fully opened position where the area of wall openings opened for flow equal the area of said sleeve flow passage, said sleeve moveable through intermediate positions decreasing the area of wall flow openings opened for flow to fully closed position where said upper sleeve seal sealingly engages said seal bore above said opened rows and said lower sleeve seal sealingly engages said seal bore below said opened rows; and (d) biased lugs on said valve sleeve engageable with said upper housing positioning grooves corresponding to the fully opened, intermediate and fully closed positions.

11. A selective pressure operated shifting tool for operating the sliding sleeve valve of claim 1 comprising:

(a) releasable selective locating means for locating said shifting tool in said sliding sleeve valve;

(b) a longitudinal flow passage in the shifting tool;

(c) invertible operating module means connected to said locating means, said module having a plurality of keys engageable in recesses in said sliding sleeve valve sleeve for moving the valve sleeve between fully opened, intermediate and fully closed positions, said module means having a mandrel and including:

pressure responsive means mounted on said mandrel responsive to a predetermined pressure in said shifting tool flow passage for moving said keys from a first retracted position to engage and move said valve sleeve, means for disengaging and holding said keys in a second retracted position after disengagement from said valve sleeve, and a positioning sleeve mounted on said mandrel for determining the distance said operating module means moves said valve sleeve before said keys are disengaged therefrom and retracted; and (d) two-way valve means connected on said invertible module means.

12. The shifting tool of claim 11 wherein the positioning sleeve has a groove in a predetermined position thereon.

13. The shifting tool of claim 11 wherein the module means are connected in said shifting tool to move the valve sleeve towards fully closed position.

14. The shifting tool of claim 11 wherein the module means is connected in said shifting tool to move the valve sleeve towards fully opened position.

15. The shifting tool of claim 11 further including means therein for disengaging the keys from the valve sleeve, said disengaging means operable by application of a predetermined pull force on said shifting tool.

16. The shifting tool of claim 11 further including quick disconnect means connected on the upper end of the releasable selective locator means, said quick disconnect means connectible to a flow conduit.

* * * * *